US005177533A

United States Patent [19]

Ishiguro et al.

[11] Patent Number: 5,177,533

[45] Date of Patent: Jan. 5, 1993

[54] IMAGE FORMING APPARATUS

[75] Inventors: Yasuyuki Ishiguro, Osaka; Hidehiro Tabuchi, Sakai; Hiromi Sakata, Suita; Yasuhiro Matsuo, Osaka; Hiroyuki Tsuji, Kyoto, all of Japan

[73] Assignee: Mit Industrial Co., Ltd., Japan

[21] Appl. No.: 871,059

[22] Filed: Apr. 20, 1992

[30] Foreign Application Priority Data

Apr. 23, 1991 [JP] Japan ..... 3-119423
Apr. 23, 1991 [JP] Japan ..... 3-119425

[51] Int. Cl.[5] ..... G03G 15/08
[52] U.S. Cl. ..... 355/215; 355/245
[58] Field of Search ..... 355/215, 245, 296

[56] References Cited

U.S. PATENT DOCUMENTS 3,838,472 10/1974 Oriel ..... 15/256.51
3,937,570 2/1976 Hudson .
4,841,331 6/1989 Nakayama et al. ..... 355/245
4,847,653 7/1989 Dol et al. ..... 355/245

*Primary Examiner*—Richard L. Moses
*Attorney, Agent, or Firm*—Beveridge, DeGrandi & Weilacher

[57] ABSTRACT

A toner recovery roller having at least its outer peripheral part made of an insulator and rotated and driven in a predetermined direction is disposed in the vicinity of a position where an image carrier and a developing roller interact with each other, and a triboelectric charging member for triboelectrically charging an outer peripheral surface of the toner recovery roller to a polarity opposite to that of toner particles is so provided as to be brought into contact with the outer peripheral surface of the toner recovery roller.

The rotation of the toner recovery roller in a predetermined direction causes friction between the friction charging member and the insulating outer peripheral surface of the toner recovery roller, so that the insulating outer peripheral surface of the toner recovery roller is triboelectrically charged to a polarity opposite to that of toner particles. Therefore, toner particles scattered from the developing roller are attracted to the toner recovery roller to adhere thereto.

A charging potential of the toner recovery roller does not immediately reach zero but remains to some extent even in cases, for example, immediately after a copying machine is stopped, when the power supply of the copying machine is turned off immediately after copying is terminated, and when a front door of the copying machine is opened by paper jamming or the like. Also in this case, therefore, floating toner particles are attracted to the toner recovery roller to adhere thereto.

15 Claims, 15 Drawing Sheets

IMAGE FORMING APPARATUS

BACKGROUND OF THE INVENTION

1. Field of the Invention

The present invention relates to image forming apparatuses such as a copying machine, a printer and a facsimile.

2. Description of the Prior Art

Examples of a copying machine already developed include one in which an electrode composed of a metal revolving roller is provided on the downstream side of a developing device in the direction of rotation of a developing roller, a bias voltage is applied to the electrode to generate an electric field between the developing roller and the electrode, toner particles are supplied to a photosensitive drum and then, toner particles remaining on the surface of the developing roller and floating toner particles are attracted to the electrode to prevent the occurrence of nonuniformity of an image and fogging (see Japanese Utility Model Laid-Open Gazette No. 57763/1989).

The above described conventional copying machine has the following disadvantages:

(a) A power supply for applying the bias voltage to the electrode is required, thereby increasing cost.

(b) A terminal such as a brush must be used so as to supply the voltage to the electrode composed of the metal revolving roller, so that the bias is liable to be unstable and the terminal must be periodically replaced.

(c) In cases, for example, immediately after the copying machine is stopped, when the power supply of the copying machine is turned off immediately after copying is terminated, and when a front door of the copying machine is opened by paper jamming or the like, the electrode is not biased, so that the floating toner particles cannot be attracted to the electrode.

(d) Since the electrode composed of the metal revolving roller has high thermal conductivity, dew condensation is brought about on the surface of the electrode composed of the metal revolving roller if the temperature is changed at the time of, for example, the replacement, so that the toner particles adhering to the electrode are melted and the melted toner particles are recovered by the developing device, thereby exerting adverse effects on the toner particles.

SUMMARY OF THE INVENTION

An object of the present invention is to provide an image forming apparatus in which the occurrence of nonuniformity of an image and fogging can be prevented, a bias voltage need not be applied, floating toner particles can be attracted even in cases, for example, immediately after it is stopped, and the toner particles are not adversely affected due to the change in temperature or the like.

A first image forming apparatus according to the present invention is characterized in that a toner recovery roller having at least its outer peripheral part made of an insulator and rotated and driven in a predetermined direction is disposed in the vicinity of a position where an image carrier and a developing roller interact with each other, and a triboelectric charging member for triboelectrically charging an outer peripheral surface of the toner recovery roller to a polarity opposite to that of toner particles is so provided as to be brought into contact with the outer peripheral surface of the toner recovery roller.

In the first image forming apparatus according to the present invention, the rotation of the toner recovery roller in a predetermined direction causes friction between the triboelectric charging member and the insulating outer peripheral surface of the toner recovery roller, so that the insulating outer peripheral surface of the toner recovery roller is triboelectrically charged to a polarity opposite to that of toner particles. Therefore, toner particles scattered from the developing roller are attracted to the toner recovery roller to adhere thereto. Further, even in cases, for example, immediately after the first image forming apparatus is stopped, when the power supply of the image forming apparatus is turned off immediately after copying is terminated, and when a front door of the image forming apparatus is opened by paper jamming or the like, a charging potential of the toner recovery roller does not immediately reach zero but remains to some extent. Also in this case, therefore, floating toner particles are attracted to the toner recovery roller to adhere thereto.

Furthermore, since at least the outer peripheral part of the toner recovery roller is made of an insulator, there is no possibility that dew condensation is brought about on the surface of the toner recovery roller due to the change in temperature, thereby exerting no adverse effect on the toner particles. When the triboelectric charging member for triboelectrically charging the outer peripheral surface of the toner recovery roller to a polarity opposite to that of the toner particles is also used as a toner scrapping member for scrapping the toner particles attracted and adhering to the toner recovery roller, the toner particles adhering to the toner recovery roller are scrapped by the triboelectric charging member and are returned to, for example, the developing device.

In the first image forming apparatus according to the present invention, the occurrence of nonuniformity of an image and fogging can be prevented. Moreover, a bias voltage need not be applied, thereby cutting cost. In addition, the floating toner particles can be attracted even in cases, for example, immediately after the first image forming apparatus is stopped, when the power supply of the image forming apparatus is turned off immediately after copying is terminated, and when the front door of the image forming apparatus is opened by paper jamming or the like. Furthermore, the toner particles are not adversely affected due to the change in temperature or the like.

Examples of the above described image carrier include a photosensitive drum, a photosensitive belt, and a dielectric drum. Examples of the above described toner recovery roller used include one whose whole is made of an insulating material, and one comprising a metal roller and an insulating layer formed on an outer peripheral surface of the metal roller.

The above described triboelectric charging member for triboelectrically charging the outer peripheral surface of the above described toner recovery roller to a polarity opposite to that of the toner particles may be also used as a toner scrapping member for scrapping the toner particles attracted to the toner recovery roller and adhering thereto.

It is preferable that the above described toner recovery roller is constituted by a conductive roller and an insulating layer formed on an outer peripheral surface of the conductive roller, and the above described triboelectric charging member is conductive. As a result, the conductive roller, the insulating layer and the triboelectric charging member constitute a capacitor structure. Charges are liable to be stored in the insulating layer, so that the trailing edges of a charging potential of the insulating layer and a charging potential after the stop of the driving of the toner recovery roller become less steep, as compared with a case where an insulating member is used as a triboelectric charging member. Therefore, the toner particles scattered from the developing roller and the floating toner particles immediately after the stop of the toner recovery roller are attracted to the toner recovery roller to adhere thereto more effectively.

Furthermore, it is preferable to rotate and drive the above described toner recovery roller intermittently and at a speed having an acceleration. Examples of a mechanism for rotating and driving the toner recovery roller intermittently and at a speed having an acceleration include one comprising a lever mounted on a shaft of the toner recovery roller and rotated integrally with the toner recovery roller in one direction of rotation while being idled with respect to the toner recovery roller in the other direction of rotation, a cam rotated at a constant speed in a predetermined direction and for rotating the lever, and urging means for always urging the lever in the direction in which the lever is idled with respect to the toner recovery roller to bring the lever into contact with the cam by pressure.

When the toner recovery roller is rotated and driven intermittently and at a speed having an acceleration, a charging potential of the toner recovery roller becomes higher, and the degree of attenuation of the charging potential after the stop of the toner recovery roller becomes slower, as compared with a case where the toner recovery roller is rotated at a constant speed. Therefore, the toner particles scattered from the developing roller or the floating toner particles in cases, for example, immediately after the first image forming apparatus are stopped, when the power supply of the image forming apparatus is turned off immediately after copying is terminated, and when the front door of the image forming apparatus is opened by paper jamming or the like are effectively attracted to the toner recovery roller to adhere thereto. As a result, it is possible to effectively prevent the occurrence of nonuniformity of an image and fogging.

It is preferable that the above described toner recovery roller is constituted by a metal roller and an insulating layer formed on an outer peripheral surface of the metal roller, and the above described insulating layer of the toner recovery roller has a thick part and a thin part in a peripheral direction. Thus, an electrostatic force due to charging is large in the thick part of the insulating layer, while being small in the thin part thereof. Consequently, the toner particles attracted to the toner recovery roller and adhering thereto are effectively scrapped when the thin pat of the insulating layer interacts with the toner scrapping member. Even if a toner attraction force due to charging of the toner recovery roller is made large, therefore, it is easy to scrap the toner particles adhering to the toner recovery roller.

It is preferable that the above described toner recovery roller and the above described triboelectric charging member are mounted on the same frame to be formed as a unit. It is preferable that the triboelectric charging member is mounted on the above described frame such that the position thereof can be adjusted with respect to the toner recovery roller. This makes it easy to respectively replace the toner recovery roller and the triboelectric charging member, and makes it easy to position the toner recovery roller and the triboelectric charging member.

It is preferable that bearing fitting notches in which bearings receiving both ends of the above described toner recovery roller are to be fitted are formed in predetermined positions of required members of the above described developing device, and the toner recovery roller is mounted on the developing device with the bearings of the toner recovery roller being respectively fitted in the bearing fitting notches. More specifically, a bearing having substantially elliptical bearing parts may be used as the above described bearing of the above described toner recovery roller, and the above described bearing fitting notch may be formed in the shape of a keyhole comprising a narrow part of an opening having a width slightly larger than the length of minor axes of the substantially elliptical bearing parts and a circular part connecting with the narrow part and having a diameter slightly larger than the length of major axes of the substantially elliptical bearing parts to fit the substantially elliptical bearing parts of the bearing of the toner recovery roller to the circular part of the bearing fitting notch by fitting the substantially elliptical bearing parts in the circular part from the narrow part of the bearing fitting notch and then, rotating the same through a predetermined angle. In this case, it is preferable that the above described toner recovery roller and the above described triboelectric charging member are mounted on the same frame to be formed as a unit.

If bearing fitting notches in which bearings receiving both ends of a toner recovery roller are to be fitted are formed in predetermined positions of required members of a developing device and the toner recovery roller is mounted on the developing device with the bearings of the toner recovery roller being respectively fitted in the bearing fitting notches, it is easy to mount the toner recovery roller on the developing device and it is easy to position the toner recovery roller and the developing roller.

A second image forming apparatus according to the present invention comprises a toner recovery roller disposed in the vicinity of a position where an image carrier and a developing roller interact with each other, a triboelectric charging member provided so as to be brought into contact with an outer peripheral surface of the toner recovery roller and for triboelectrically charging the outer peripheral surface of the toner recovery roller to a polarity opposite to that of toner particles, and a toner scrapping member for scrapping toner particles attracted to the toner recovery roller and adhering thereto, which is characterized in that the toner recovery roller comprises a metal roller and an insulating layer formed on an outer peripheral surface of the metal roller, and the insulating layer of the toner recovery roller has a thick part and a thin part in a peripheral direction.

Examples of the image carrier include a photosensitive drum, a photosensitive belt, and a dielectric drum. The triboelectric charging member may be also used as a toner scrapping member. That is, the above described triboelectric charging member for triboelectrically charging the outer peripheral surface of the above described toner recovery roller to a polarity opposite to that of toner particles may be used as a toner scrapping member for scrapping toner particles attracted to the toner recovery roller and adhering thereto.

In the second image forming apparatus according to the present invention, the rotation of the toner recovery roller causes friction between the triboelectric charging member and the insulating layer of the toner recovery roller, so that the insulating layer of the toner recovery roller is triboelectrically charged to a polarity opposite to that of the toner particles. Therefore, toner particles scattered from the developing roller or floating toner particles in cases, for example, immediately after the second image forming apparatus is stopped, when the power supply of the image forming apparatus is turned off immediately after copying is terminated, and when a front door of the image forming apparatus is opened by paper jamming or the like are attracted to the toner recovery roller to adhere thereto. The toner particles attracted to the toner recovery roller and adhering thereto are scrapped by the toner scrapping member and are returned to, for example, the developing device.

Since the insulating layer of the toner recovery roller has a thick part and a thin part in a peripheral direction, an electrostatic force due to charging is large in the thick part of the insulating layer, while being small in the thin part thereof. Consequently, the toner particles attracted to the toner recovery roller and adhering thereto are effectively scrapped when the thin part of the insulating layer interacts with the toner scrapping member.

In the second image forming apparatus according to the present invention, it is possible to prevent the occurrence of nonuniformity of an image and fogging. Moreover, a bias voltage need not be applied, thereby cutting cost. In addition, the floating toner particles can be attracted even in cases, for example, immediately after the second image forming apparatus is stopped, when the power supply of the image forming apparatus is turned off immediately after copying is terminated, and when the front door of the image forming apparatus is opened by paper jamming or the like. Furthermore, since the toner particles are not adversely affected due to the change in temperature or the like. In addition, since the insulating layer in the outer peripheral part of the toner recovery roller has a thick part and a thin part in a peripheral direction, it is easy to scrap the toner particles adhering to the toner recovery roller even if a toner attraction force due to charging of the toner recovery roller is made large.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Description is now made of embodiments of the present invention which is applied to a copying machine with reference to the drawings.

Figure 1:
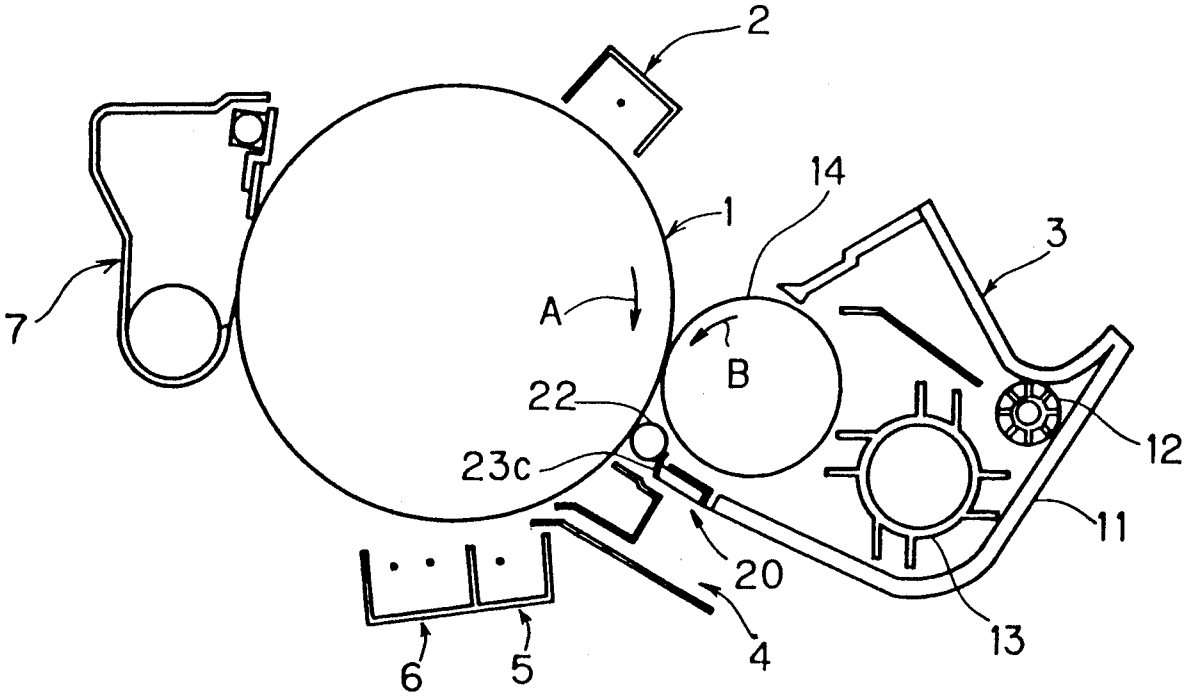
FIG. 1 is a diagram showing the structure of an image forming section of a copying machine.

FIG. 1 is an image forming section of a copying machine.

A charger 2 for charging a photosensitive layer on the surface of a photosensitive drum 1, a developing device 3 for developing an electrostatic latent image formed on the photosensitive layer as a toner image, a paper guide path 4 for guiding paper to the photosensitive drum 1, a transferring corona discharger 5 for transferring the toner image formed on the photosensitive layer to the paper, a separating corona discharger 6 for separating the paper from the photosensitive drum 1, and a cleaning device 7 for removing toner particles remaining on the photosensitive drum 1 after the transfer are disposed around the photosensitive drum 1 in the direction of rotation of the photosensitive drum 1 ( in a direction indicated by an arrow A in FIG. 1).

A developing spiral 12, an agitating roller 13, and a developing roller 14 are disposed in a housing 11 of the developing device 3. A toner recovery unit 20 is mounted on the housing 11 of the developing device 3.

Figure 2:
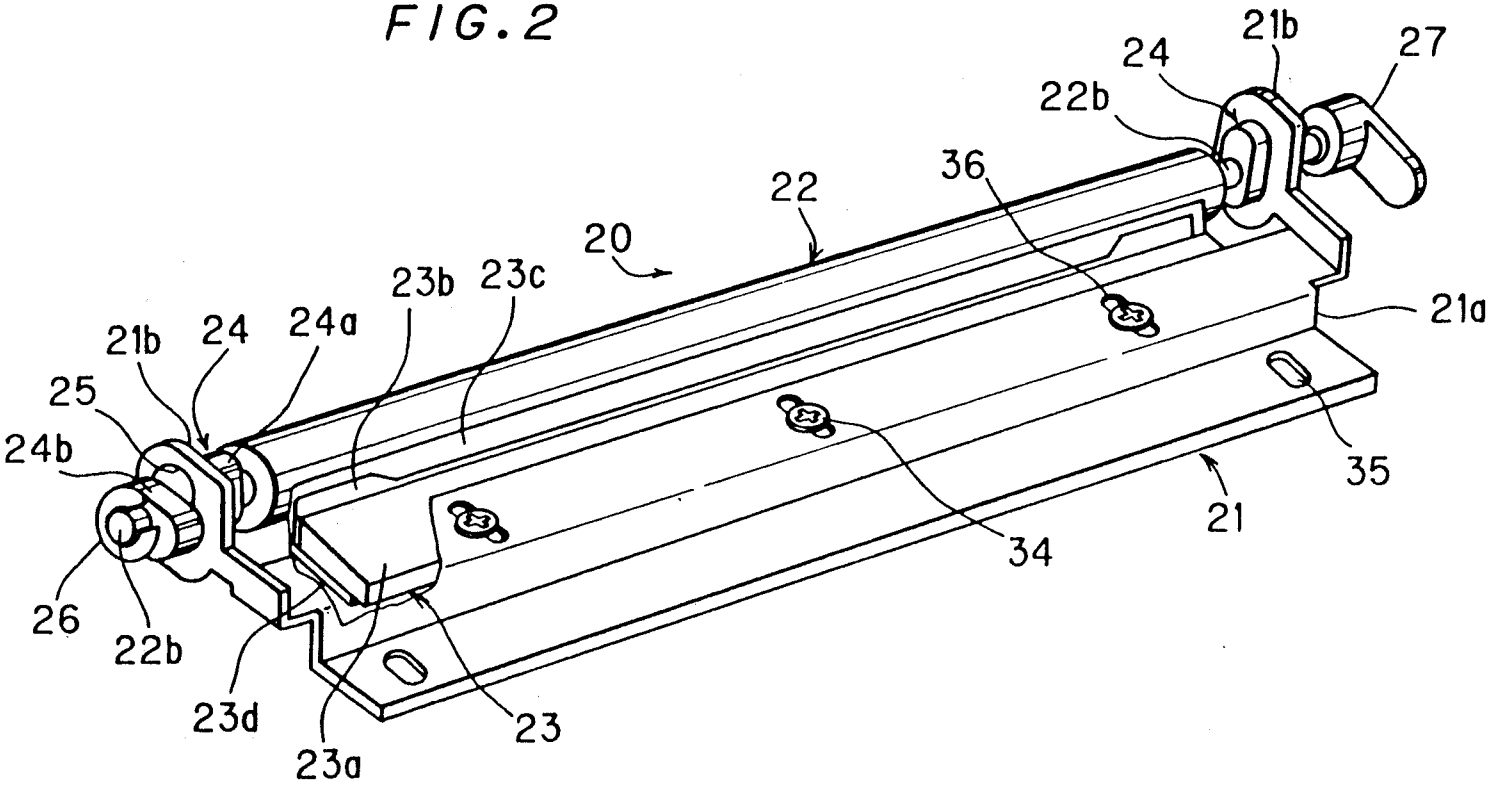
FIG. 2 is an enlarged perspective view showing a toner recovery unit.
Figure 3:
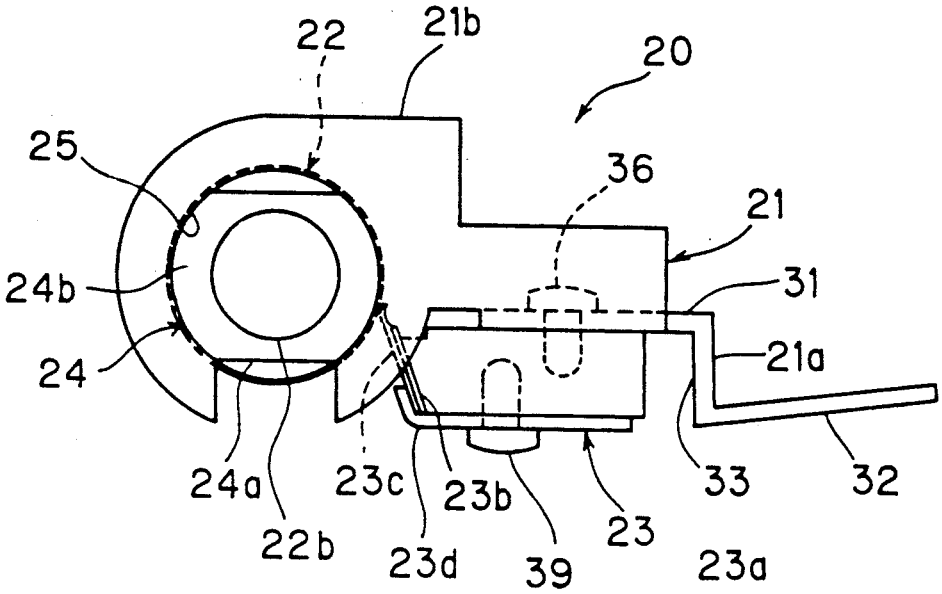
FIG. 3 is an enlarged side view showing the toner recovery unit.
Figure 4:
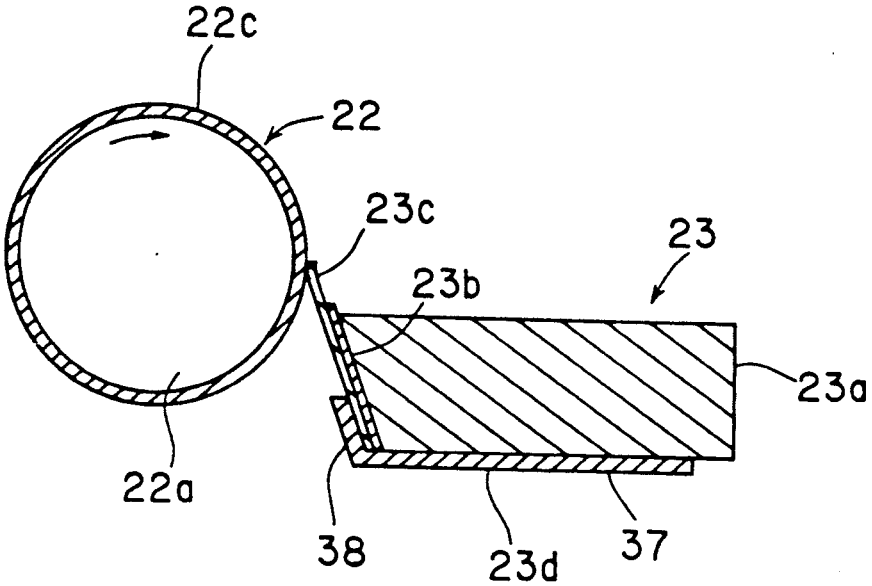
FIG. 4 is an enlarged sectional view showing a toner recovery roller and a toner scrapping and triboelectric charging unit.

FIGS. 2 to 4 show a toner recovery unit 20.

In the following description, the front refers to the left side of FIG. 3, and the rear refers to the right side of FIG. 3.

The toner recovery unit 20 comprises a frame 21, a toner recovery roller 22 rotatably mounted on the frame 21, and a toner scrapping and triboelectric charging unit 23 mounted on the frame 21.

The frame 21 comprises a base 21*a* extending along the length of the developing roller 14 and a pair of bearing parts 21*b* formed in both ends of the base 21*a*. The base 21*a* comprises an upper wall 31 approximately parallel to a lower wall of the housing 11 of the developing device 3, a lower wall 32 approximately parallel to the upper wall 31 at the rear of the upper wall 31, and a connecting wall 33 for connecting the upper wall 31 and the lower wall 32. The upper wall 31 is provided with a plurality of laterally long narrow screw inserting long holes 34 with predetermined spacing along its length. Laterally long narrow screw inserting long holes 35 are also formed in both ends of the lower wall 32.

The bearing parts 21*b* are provided so as to be projected upward and forward from both ends of the upper wall 31, and a bearing made of synthetic resin 24 is mounted on each of the bearing parts 21*b* in a penetrated state. The bearing 24 comprises two substantially elliptical parts (koban-shaped parts) 24*a* and 24*b*. Both the substantially elliptical parts 24*a* and 24*b* are coupled to each other with their major axes forming an angle of 90° with each other. The inside substantially elliptical parts 24*a* of the bearings 24 are respectively fitted in substantially elliptical holes 25 formed in both the bearing parts 21*b*.

The toner recovery roller 22 is disposed between the photosensitive drum 1 and the developing roller 14 and on the downstream side of the developing roller 14 in the direction of rotation of the developing roller 14 (in a direction indicated by an arrow B in FIG. 1). The toner recovery roller 22 is formed by coating the entire outer peripheral surface of a metal roller 22*a* having shaft parts 22*b* having a small diameter on its ends with an insulating layer 22*c*. Examples of a material of the roller 22*a* include non-magnetic stainless steel. Examples of a material of the insulating layer 22*c* include synthetic resin such as nylon resin (for example, Asahi Placoat ARM-900 (trade name)).

Both the shaft parts 22*b* of the toner recovery roller 22 are rotatably inserted through the corresponding bearings 24, respectively. A stopper 26 is fitted to an end projected from the bearing 24 of one of the shaft parts 22*b*. A lever 27 is mounted on an end projected from the bearing 24 of the other shaft part 22*b* such that it is rotated integrally with the shaft part 22*b* in one direction while being idled with respect to the shaft part 22*b* in the opposite direction.

The toner scrapping and triboelectric charging unit 23 comprises a sheet supporting member 23*a* trapezoidal in cross section which extends along the length of the developing roller 14 and whose front surface is inclined diagonally up to the front, a toner scrapping and triboelectric charging sheet 23*c* applied to the front surface of the sheet supporting member 23*a* through a reinforcing sheet 23*b*, and a supporting plate 23*d* for supporting the toner scrapping and triboelectric charging sheet 23*c* and the reinforcing sheet 23*b* with they being interposed between the supporting plate 23*d* and the front surface of the sheet supporting member 23*a*.

The sheet supporting member 23*a* is applied to a lower surface of the upper wall 31 of the base 21*a* of the frame 21 and is attached to the frame 21 by screws 36 inserted through the screw inserting long holes 34.

The supporting plate 23*d* is in a substantially L shape in cross section, and comprises a fixing part 37 along a lower surface of the sheet supporting member 23*a* and a supporting part 38 along the front surface of the sheet supporting member 23*a*. The fixing part 37 is attached to the sheet supporting member 23*a* by a screw 39 with the tone scrapping and triboelectric charging sheet 23*c* and the reinforcing sheet 23*b* being interposed between the supporting part 38 and the front surface of the sheet supporting member 23*a*, so that the toner scrapping and triboelectric charging sheet 23*c* and the reinforcing sheet 23*b* are mounted on the sheet supporting member 23*a*.

An upper part of the toner scrapping and triboelectric charging sheet 23*c* is projected upward from the reinforcing sheet 23*b* and is brought into contact with the toner recovery roller 22 by pressure. The reinforcing sheet 23*b* is used for reinforcing the toner scrapping and triboelectric charging sheet 23*c*. The reinforcing sheet 23*b* is so formed that the vertical widths in its ends are large in consideration of the fact that both ends of the toner scrapping and triboelectric charging sheet 23*c* are more limp than the center thereof.

Examples of the toner scrapping and triboelectric charging sheet 23*c* include a synthetic resin sheet such as a polyester sheet, and a conductive sheet (for example, a cast molding type polycarbonate film containing special conductive carbon (trade name KL3) manufactured by Banteck Co. Ltd.). Examples of the reinforcing sheet 23*b* include a synthetic resin sheet such as a polyester sheet.

In the above described manner, the toner recovery roller 22 and the toner scrapping and triboelectric charging sheet 23*c* are formed as a unit, so that they can be easily replaced, respectively. In addition, the toner scrapping and triboelectric charging unit 23 is attached to the frame 21 by the screws 36 inserted through the screw inserting long holes 34. Accordingly, it is possible to accurately position the toner recovery roller 22 and the toner scrapping and triboelectric charging sheet 23*c* using a jig or the like at the time of assembling the toner recovery unit 20. Therefore, the toner scrapping and triboelectric charging sheet 23*c* can be accurately positioned in a position where toner particles can be effectively scrapped and the contact pressure is not too high with respect to the toner recovery roller 22.

Figure 5:
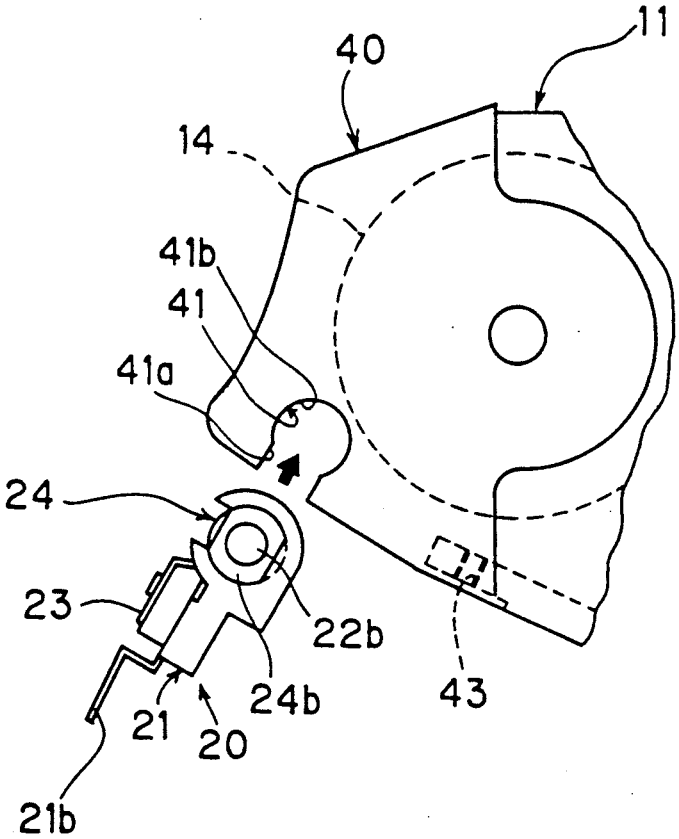
FIG. 5 is an enlarged side view showing a method of mounting the toner recovery unit on a housing of a developing device.
Figure 6:
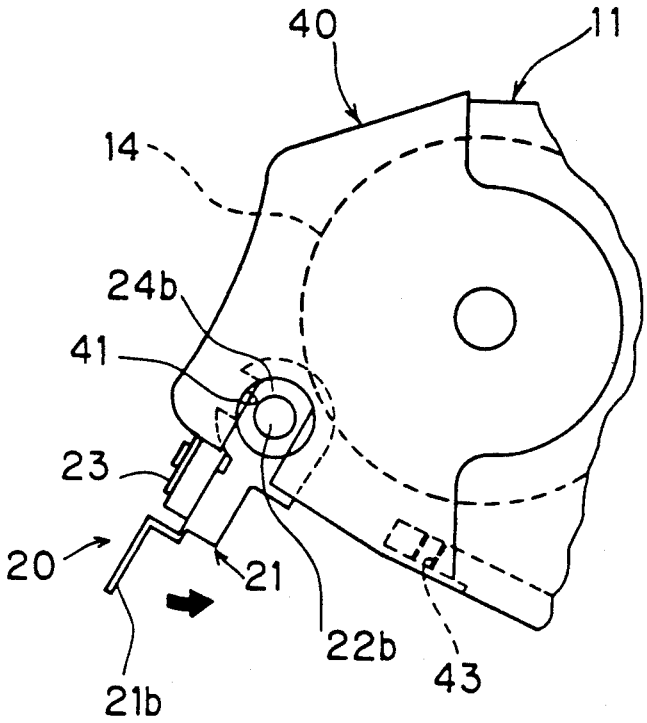
FIG. 6 is an enlarged side view showing a method of mounting the toner recovery unit on the housing of the developing device.
Figure 7:
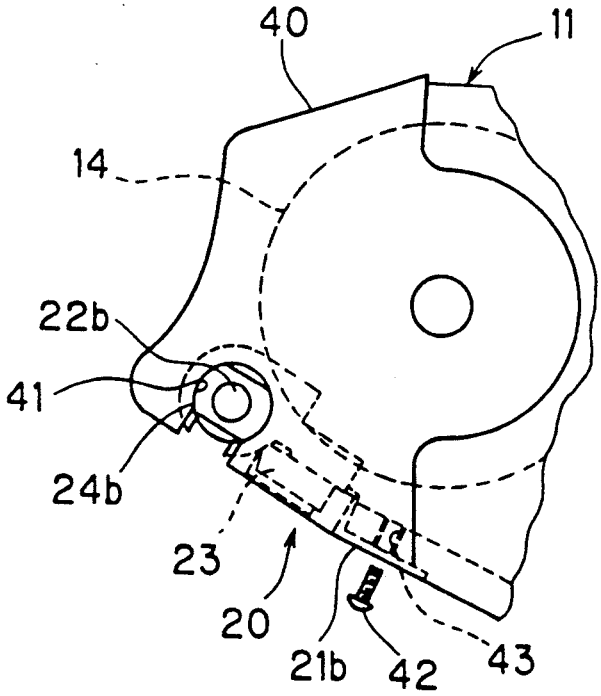
FIG. 7 is an enlarged side view showing a method of mounting the toner recovery unit on the housing of the developing device.

FIGS. 5 to 7 show a structure in which the toner recovery unit 20 is mounted on the housing 11 of the developing device 3 and a mounting method.

Bearing members 40 of the developing roller 14 are fixed to both end faces of the housing 11 of the developing device 3. Keyhole-shaped notches 41 in which the bearings 24 for the toner recovery roller 22 in the toner recovery unit 20 are to be fitted are respectively formed in lower front ends of both the bearing members 40. Each of the notches 41 comprises a narrow part 41*a* of an opening and a circular part 41*b* connecting with the narrow part 41*a*. The width of the narrow part 41*a* is made slightly larger than the length of the minor axes of the substantially elliptical parts 24*a* and 24*b* of the bearing 24. The diameter of the circular part 41*b* is made slightly larger than the length of the major axes of the substantially elliptical parts 24*a* and 24*b* of the bearing 24.

In mounting the toner recovery unit 20 on the housing 11, the outside substantially elliptical part 24*b* of each of the bearings 24 in the toner recovery unit 20 is first fitted in the circular part 41*b* of the notch 41 from the narrow part 41*a* thereof such that the direction of the major axis thereof coincides with the direction of the depth of the notch 41, as shown in FIGS. 5 and 6.

As shown in FIGS. 6 and 7, the toner recovery unit 20 is then rotated through an angle of approximately 90° in a counterclockwise direction about the shaft part 22*b*, to apply the lower wall 32 of the base 21*a* of the frame 21 to an outer surface of the lower wall of the housing 11, as shown in FIGS. 6 and 7.

In this case, the substantially elliptical part 24*b* of each of the bearings 24 is rotated through an angle of approximately 90°, so that the direction of the minor axis thereof coincides with the direction of the depth of the notch 41, as shown in FIG. 7. Accordingly, the substantially elliptical part 24*b* of each of the bearings 24 enters a state where it does not slip off the circular part 41*b* of the notch 41.

Thereafter, screws 42 inserted through the screw inserting long holes 35 formed in the lower wall 32 of the frame 21 are respectively fitted in threaded holes 43 formed in the lower wall of the housing 11, so that the toner recovery unit 20 is mounted on the housing 11. A metal roller 22*a*of the toner recovery roller 22 is not grounded.

It is thus possible to mount the toner recovery unit 20 on the developing device 3 in a simple operation of respectively fitting the bearings 24 in the toner recovery unit 20 in the notches 41 formed in the bearing members 40 of the developing roller 14 and then, rotating the toner recovery unit 20 to attach the same to the housing 11 by the screws 42.

Furthermore, since the bearings 24 in the toner recovery unit 20 are respectively fitted in the notches 41 formed in the bearing members 40 of the developing roller 14, the toner recovery roller 22 and the developing roller 14 are accurately positioned.

Additionally, in a state where the toner recovery unit 20 is mounted on the developing device 3, the screws 36 for adjusting the positions of the toner recovery roller 22 and the toner scrapping and triboelectric charging sheet 23*c* are put in positions where they cannot be operated. Accordingly, the screws 36 are not erroneously operated, thereby to hold a good positional relationship between the toner recovery roller 22 and the toner scrapping and triboelectric charging sheet 23*c*.

Figure 8:
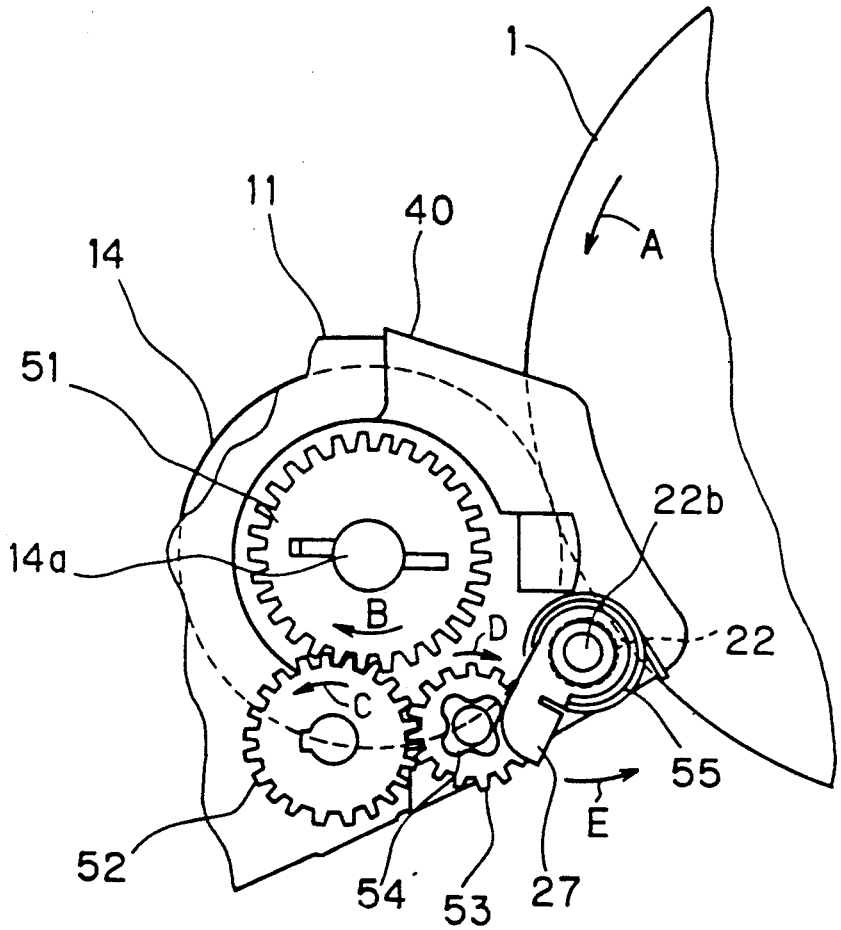
FIG. 8 is an enlarged side view showing a driving mechanism of the toner recovery roller.

FIG. 8 shows a driving mechanism of the toner recovery roller 22.

On the side of an outer surface of one of bearing members 40 of the developing roller 14, a gear 51 is fitted to one end of a shaft 14*a* of the developing roller 14. A gear 52 rotatably mounted on the bearing member 40 is engaged with the gear 51. In addition, a gear 53 rotatably mounted on the bearing member 40 is engaged with the gear 52. A substantially rectangular cam 54 having four concave-shaped curved surfaces on its outer periphery is fixed to a shaft of the gear 53.

A lever 27 mounted on one of the shaft parts 22*b* of the toner recovery roller 22 is rotated integrally with the shaft part 22*b* in a direction indicated by an arrow E in FIG. 8, while being idled with respect to the shaft part 22*b* in the opposite direction. The lever 27 is always urged in the opposite direction to the direction indicated by the arrow E with respect to the shaft part 22*b* by a spring 55, and the urging force causes an end of the lever 27 to be brought into contact with the outer peripheral surface of the cam 54 by pressure.

When the shaft 14*a* of the developing roller 14 is driven by a driving motor (not shown), the gear 51 is rotated in a direction indicated by an arrow B, and the gear 52 is rotated in a direction indicated by an arrow C as the gear 51 is rotated. In addition, the gear 53 is rotated in a direction indicated by an arrow D as the gear 52 is rotated, so that the cam 54 is rotated in the same direction.

The lever 27 swings back and forth within a constant angle range as the cam 54 is rotated. When the lever 27 is rotated in the direction indicated by the arrow E, it causes the toner recovery roller 22 to be rotated in the direction. That is, the toner recovery roller 22 is rotated intermittently and at a speed having a large acceleration.

Figure 9:
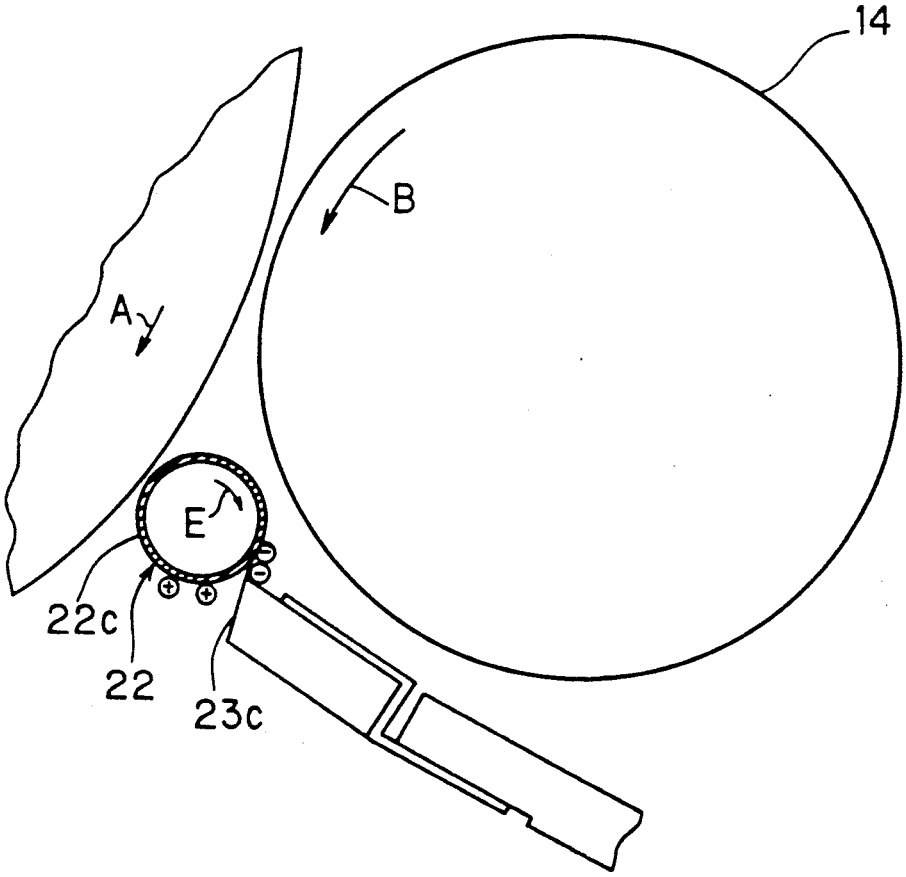
FIG. 9 is a diagram for explaining a state where an insulating layer on the surface of the toner recovery roller is charged by friction between the toner recovery roller and a toner scrapping and triboelectric charging sheet.
Figure 10:
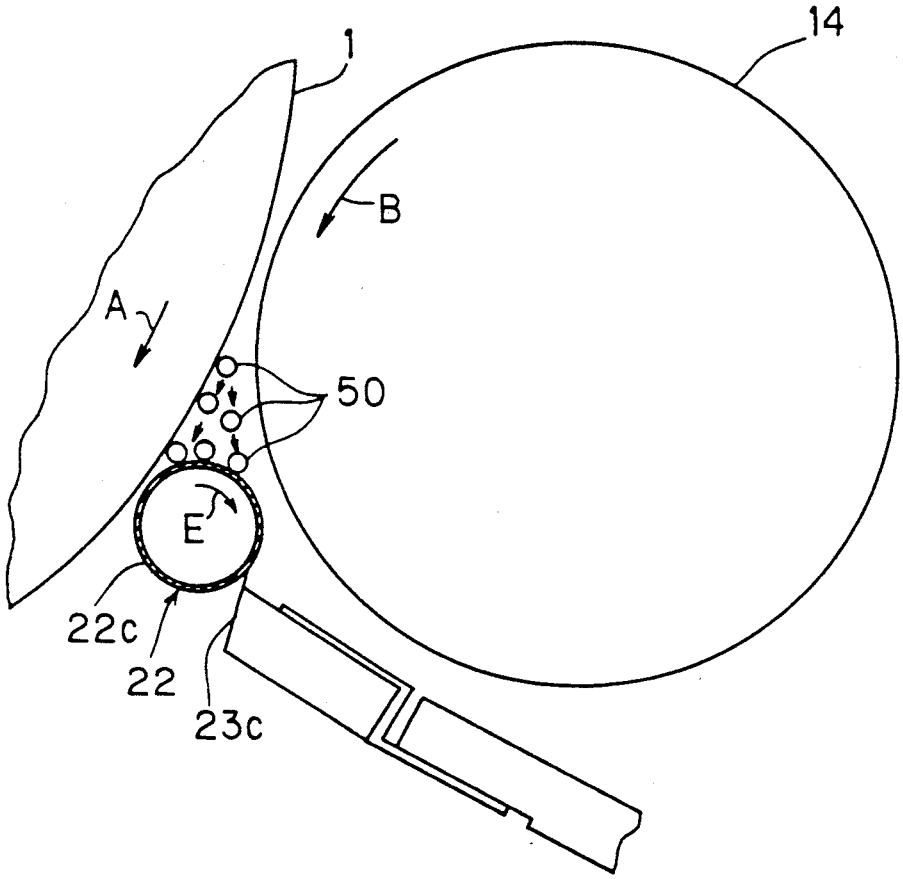
FIG. 10 is a diagram for explaining a state where toner particles scattered from the developing roller are attracted to the insulating layer on the surface of the toner recovery roller to adhere thereto.
Figure 11:
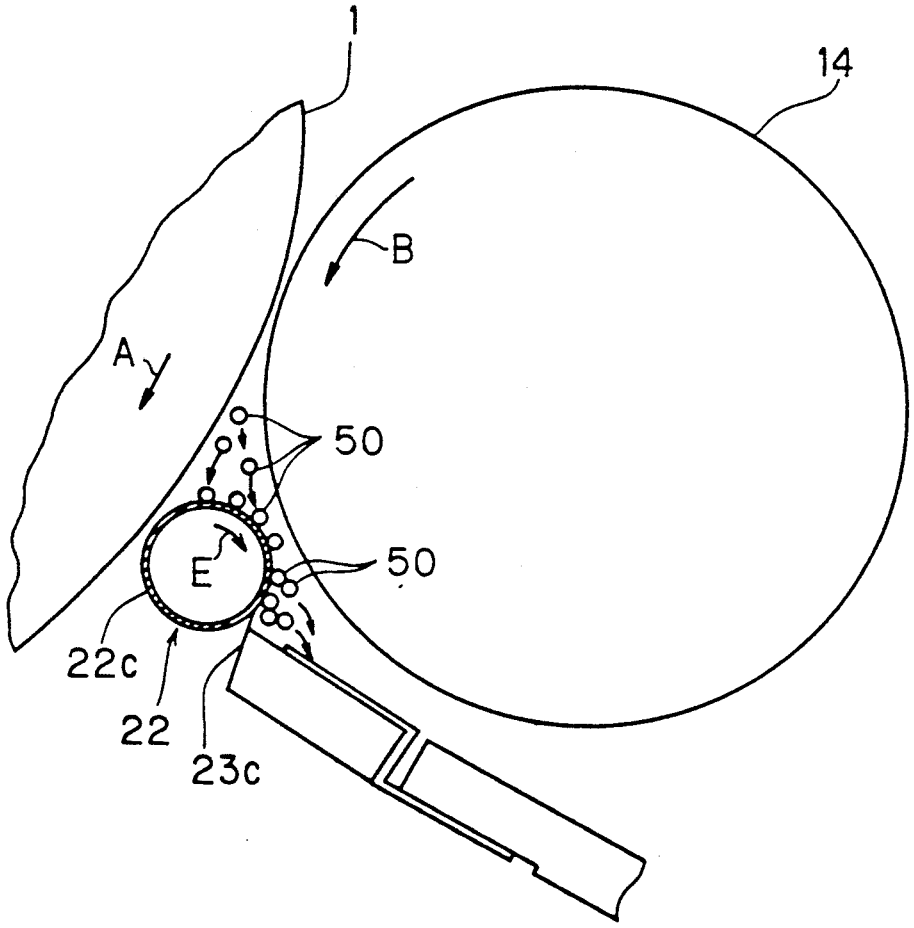
FIG. 11 is a diagram for explaining a state where toner particles adhering to the insulating layer on the surface of the toner recovery roller are scrapped by the toner scrapping and triboelectric charging sheet and are returned to the housing of the developing device.

FIGS. 9 to 11 show a state where toner particles scattered from the developing roller 14 are attracted to the toner recovery roller 22 and the toner particles attracted are returned to the developing device 3.

In FIGS. 9 to 11, arrows A, B and E respectively indicate the directions of rotation of the photosensitive drum 1, the developing roller 14 and the toner recovery roller 22.

The rotation of the toner recovery roller 22 causes friction between the toner scrapping and triboelectric charging sheet 23*c* and the insulating layer 22*c* on the surface of the toner recovery roller 22. Accordingly, negative (−) charges are moved to the toner scrapping and triboelectric charging sheet 23*c* from the insulating layer 22*c*, so that the insulating layer 22*c* is positively charged, as shown in FIG. 9.

Since the toner particles have a negative polarity, toner particles 50 scattered from the developing roller 14 are attracted to the insulating layer 22*c* on the surface of the toner recovery roller 22 to adhere to the insulating layer 22*c*, as shown in FIG. 10.

The toner particles 50 adhering to the insulating layer 22*c* on the surface of the toner recovery roller 22 are scrapped by the toner scrapping and triboelectric charging sheet 23*c*, and are returned to the housing 11 of the developing device 3 by a brush of the developing roller 14, as shown in FIG. 11.

Meanwhile, a charging potential of the toner recovery roller 22 does not immediately reach zero but remains to some extent even in cases, for example, immediately after the copying machine is stopped, when the power supply of the copying machine is turned off immediately after copying is terminated, and when the front door of the copying machine is opened by paper jamming or the like. Also in this case, floating toner particles are attracted to the toner recovery roller 22 to adhere thereto, and are returned to the housing 11 of the developing device 3.

In the above described manner, the toner particles scattered from the developing roller 14 and the floating toner particles can be recovered, thereby to prevent the occurrence of nonuniformity of an image and fogging. Since the outer peripheral surface of the toner recovery roller 22 is covered with the insulating layer 22*c*, there is no possibility that dew condensation is brought about on the surface of the toner recovery roller 22 due to the change in temperature, thereby exerting no adverse effect on the toner particles.

Figure 12:
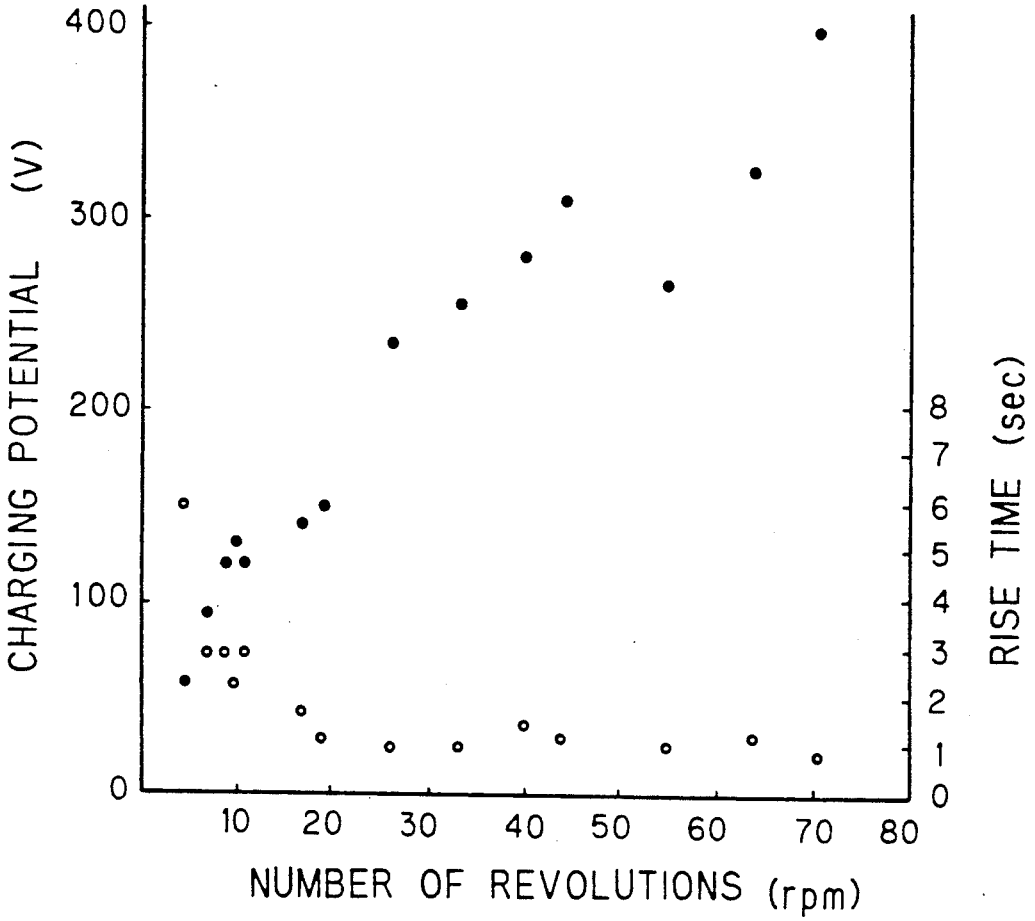
FIG. 12 is a graph showing experimental data of a charging potential of the insulating layer on the surface of the toner recovery roller relative to the average number of revolutions of the toner recovery roller and rise time of a charging potential immediately after the start of the rotation of the toner recovery roller relative to the average number of revolutions of the toner recovery roller.

FIG. 12 shows experimental data of a charging potential [V] of the insulating layer 22*c* on the surface of the toner recovery roller 22 relative to the average number of revolutions [rpm] of the toner recovery roller 22 (the number of revolutions of the gear 53) and rise time [sec] of a charging potential immediately after the start of the rotation of the toner recovery roller 22 relative to the average number of revolutions [rpm] of the toner recovery roller 22. In FIG. 12, a black circle indicates the charging potential, and a white circle indicates the rise time.

It is understood from FIG. 12 that the higher the average number of revolutions of the toner recovery roller 22 is, the higher the rise speed of the charging potential immediately after the start of the rotation of the toner recovery roller 22 is and the higher the charging potential is.

However, the higher the average number of revolutions of the toner recovery roller 22 is, the higher the degree of wear of the toner scrapping and triboelectric charging sheet 23*c* is, so that it is preferable that the number of revolutions of the gear 53 is 20 to 70 [rpm].

In the present embodiment, the toner recovery roller 22 is rotated intermittently and at a speed having a large acceleration by the cam 54 and the lever 27. Accordingly, the rise speed of the charging potential immediately after the start of the rotation of the toner recovery roller 22 is higher and the charging potential is higher, as compared with a case where the toner recovery roller 22 is rotated at the same constant speed as the rotation speed of the gear 53.

For example, in order to obtain a charging potential approximately equal to the charging potential of the insulating layer 22*c* on the surface of the toner recovery roller 22 which is generated when the gear 53 is rotated at a speed of 60 [rpm] in the present embodiment by rotating the toner recovery roller 22 at a constant speed, the toner recovery roller 22 must be rotated at a high speed of approximately 500 [rpm], thereby reducing the life of the toner scrapping and triboelectric charging sheet 23*c*.

Figure 13:
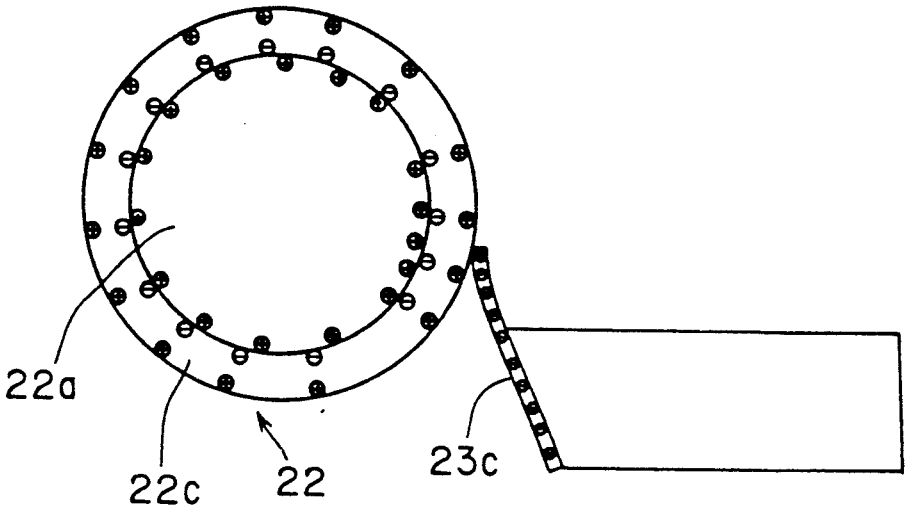
FIG. 13 is a schematic diagram showing a state where the toner recovery roller and the toner scrapping and triboelectric charging sheet are charged when a conductive sheet is used as the toner scrapping and triboelectric charging sheet.

FIG. 13 shows a state where the toner recovery roller 22 and the toner scrapping and triboelectric charging sheet 23*c* are charged when a conductive sheet is used as the toner scrapping and triboelectric charging sheet 23*c*.

By the friction between the toner recovery roller 22 and the toner scrapping and triboelectric charging sheet 23*c*, the outer surface of the insulating layer 22*c* on the surface of the toner recovery roller 22 is positively charged, the inner surface of the insulating layer 22*c* is negatively charged, and the roller 22*a* of the toner recovery roller 22 is positively charged. In addition, the toner scrapping and triboelectric charging sheet 23*c* is negatively charged.

When the conductive sheet is used as the toner scrapping and triboelectric charging sheet 23*c*, the roller 22*a*, the insulating layer 22*c*, and the toner scrapping and friction charging sheet 23*c* constitute a capacitor structure in which the insulating layer which is an insulator is interposed between the roller 22*a* and the toner scrapping and triboelectric charging sheet 23*c* which are conductors.

In this case, therefore, charges are liable to be stored in the insulating layer 22*c*, and the trailing edges of the charging potential of the insulating layer 22*c* and the charging potential after the stop of driving of the toner recovery roller 22 become less steep, as compared with a case where an insulating sheet is used as the toner scrapping and triboelectric charging sheet 23*c*.

Figure 14:
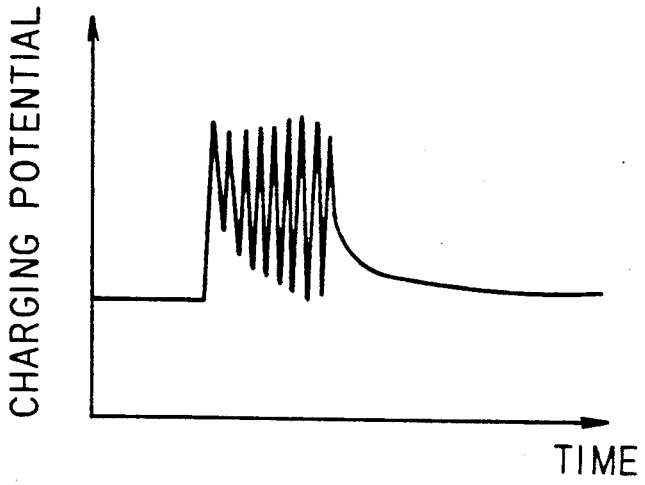
FIG. 14 is a graph showing a charging potential of the toner recovery roller in a case where a conductive sheet is used as the toner scrapping and triboelectric charging sheet.
Figure 15:
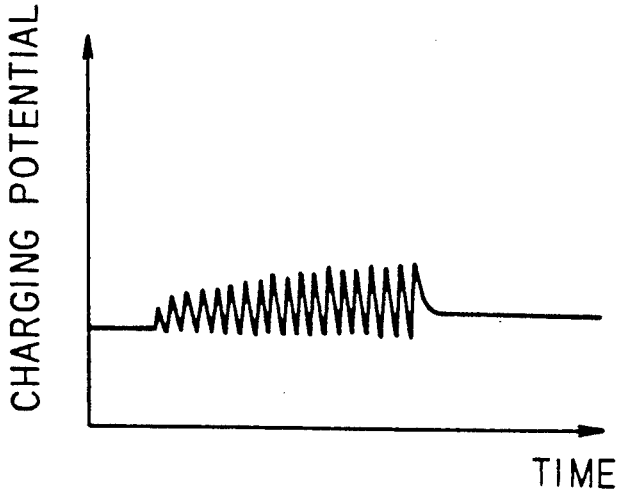
FIG. 15 is a graph showing a charging potential of the toner recovery roller in a case where an insulating sheet is used as the toner scrapping and triboelectric charging sheet.

FIG. 14 shows a charging potential of the toner recovery roller 22 in a case where a conductive sheet (a cast molding type polycarbonate film containing special conductive carbon (trade name KL3) manufactured by Banteck Co., Ltd.) is used as the toner scrapping and triboelectric charging sheet 23*c*, and FIG. 15 shows a charging potential of the toner recovery roller 22 in a case where an insulating sheet (polyester sheet) is used as the toner scrapping and triboelectric charging sheet 23*c*.

Although in the above described embodiment, the toner recovery roller 22 is constituted by the metal roller 22*a* and the insulating layer 22*c* formed on the outer peripheral surface of the roller 22*a*, the whole of toner recovery roller 22 may be made of an insulator such as synthetic resin.

Furthermore, although in the above described embodiment, the toner recovery roller 22 is rotated intermittently and at a speed having a large acceleration by the cam 54 and the lever 27, the toner recovery roller 22 may be rotated at a constant speed.

Additionally, although in the above described embodiment, the triboelectric charging member for triboelectrically charging the outer peripheral surface of the toner recovery roller to a polarity opposite to that of toner particles and the toner scrapping member for scrapping toner particles attracted to the toner recovery roller and adhering thereto are composed of the same member (the toner scrapping and triboelectric charging sheet 23*c*), a triboelectric charging member and a toner scrapping member may be separately provided.

Figure 16:
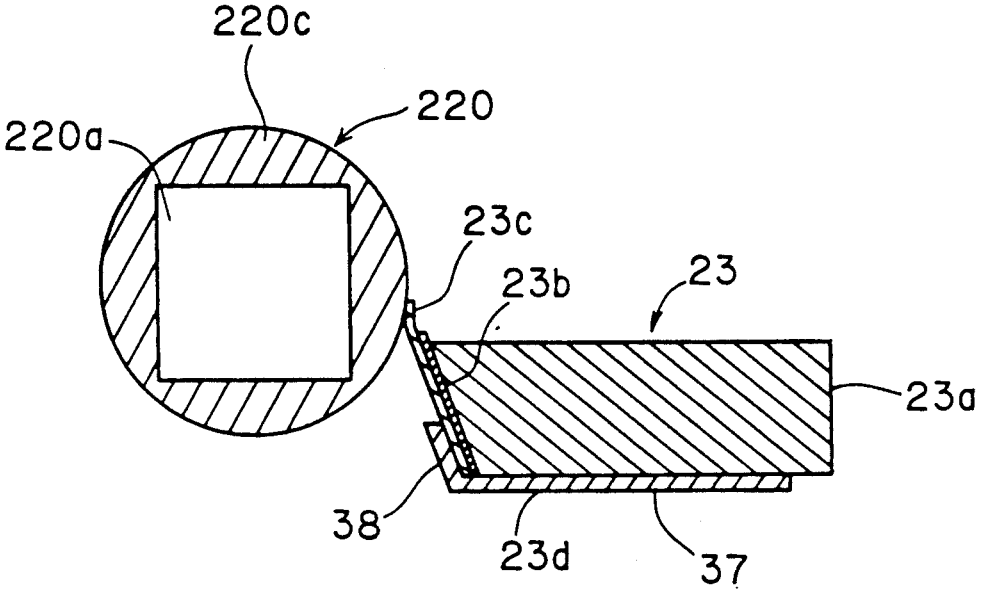
FIG. 16 is a transverse sectional view showing a modified example of a toner recovery roller.

FIG. 16 shows a modified example of a toner recovery roller.

A toner recovery roller 220 is so formed as to be in a circular shape in cross section centered at the center in cross section of a roller 220*a* which is square in cross section after an outer surface of the roller 220*a* is coated with insulating synthetic resin. Consequently, the thickness of an insulating layer 220*c* is the largest in the center of each of the sides of a rectangle in cross section of the roller 220*a*, is gradually smaller from the center of each of the sides of the rectangle in cross section of the roller 220*a* toward each of vertexes thereof, and is the smallest in each of the vertexes of the rectangle in cross section of the roller 220*a*. That is, the insulating layer 220*c* has a thick part and a thin part in a peripheral direction.

Figure 17:
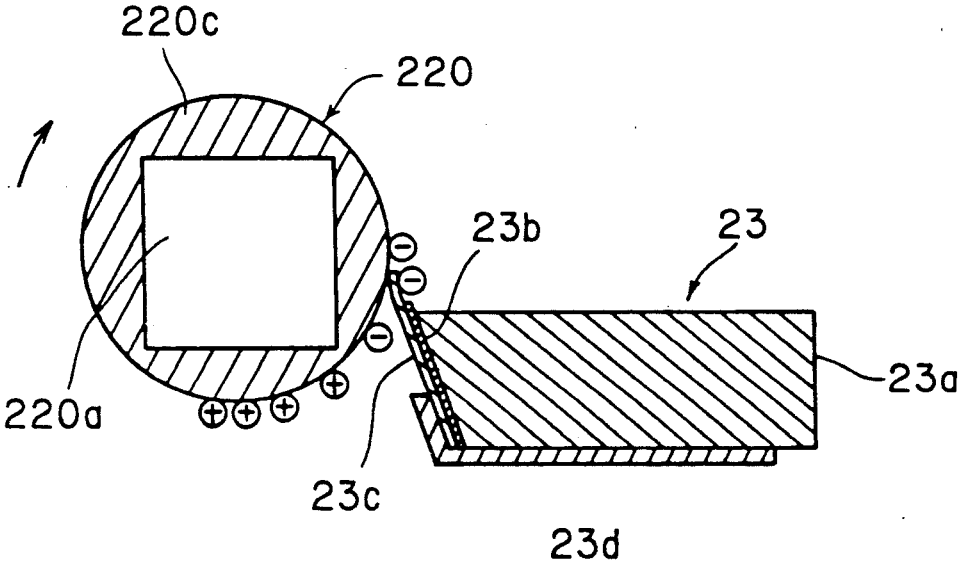
FIG. 17 is a diagram for explaining a state where an insulating layer on the surface of the toner recovery roller is charged by friction between the toner recovery roller and a toner scrapping and triboelectric charging sheet.
Figure 18:
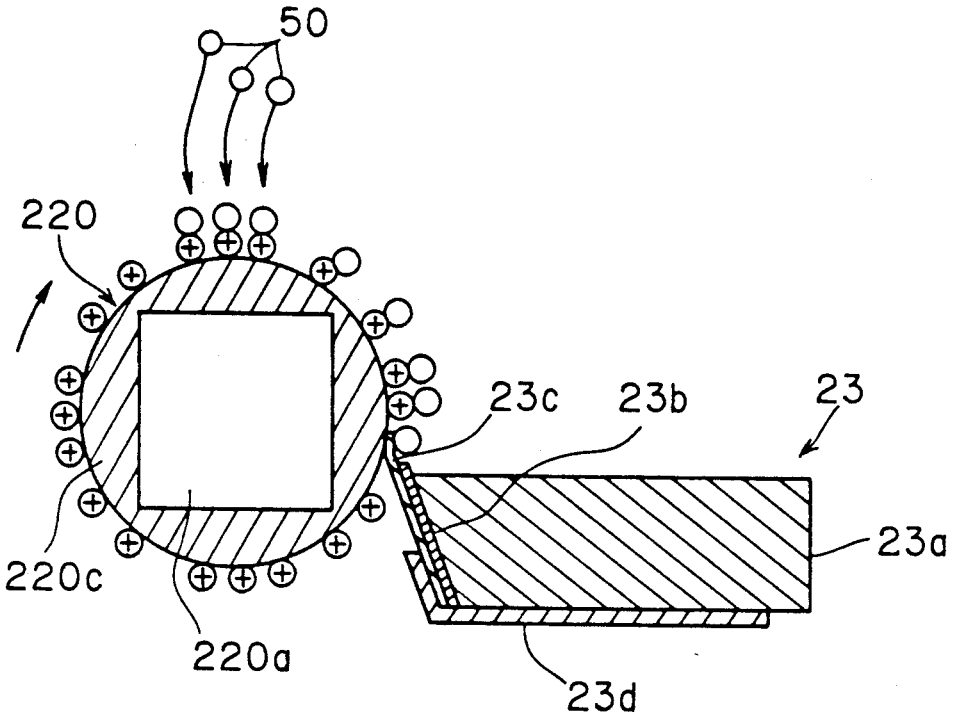
FIG. 18 is a diagram for explaining a state where toner particles scattered from a developing roller are attracted to the insulating layer on the surface of the toner recovery roller to adhere thereto.
Figure 19:
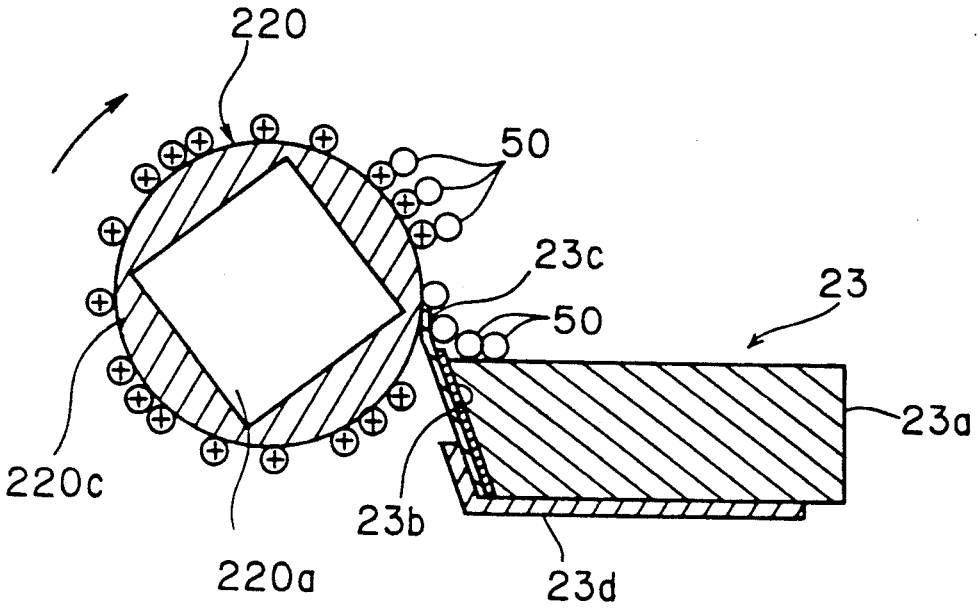
FIG. 19 is a diagram for explaining a state where toner particles adhering to the insulating layer on the surface of the toner recovery roller are scrapped by the toner scrapping and triboelectric charging sheet and are returned to a housing of a developing device.

FIGS. 17 to 19 show a state where toner particles scattered from a developing roller 14 are attracted to a toner recovery roller 220 and the toner particles attracted are returned to a developing device 3.

The rotation of the toner recovery roller 220 causes friction between a toner scrapping and triboelectric charging sheet 23*c* and an outer surface of an insulating layer 220*c* on the surface of the toner recovery roller 220, so that negative (−) charges are moved to the toner scrapping and triboelectric charging sheet 23*c* from the outer surface of the insulating layer 220*c*, so that the outer surface of the insulating layer 220*c* is positively charged, as shown in FIG. 17. In this case, the amount of positive (+) charges in a thick part of the insulating layer 220*c* of the toner recovery roller 220 becomes larger than that in a thin part of the insulating layer 220*c*.

Since toner particles have a negative polarity, toner particles 50 scattered from the developing roller 14 are attracted to the outer surface of the insulating layer 220*c* of the toner recovery roller 220 to adhere to the outer surface of the insulating layer 220*c*.

The toner particles 50 adhering to the outer surface of the insulating layer 220*c* of the toner recovery roller 220 are scrapped by the toner scrapping and triboelectric charging sheet 23*c*, as shown in FIG. 19. In this case, an electrostatic force in the thick part of the insulating layer 220*c* of the toner recovery roller 220 is large. Accordingly, when the thick part of the insulating layer 220*c* interacts with the toner scrapping and triboelectric charging sheet 23*c*, the toner particles adhering to the thick part are not easily scrapped, so that the toner particles are shifted on the surface of the toner recovery roller 220 in the opposite direction to the direction of rotation thereof.

When the thin part of the insulating layer 220*c*having a small electrostatic force interacts with the toner scrapping and triboelectric charging sheet 23*c*, the toner particles are effectively scrapped by the toner scrapping and triboelectric charging sheet 23*c*, and are returned to a housing 11 of the developing device 3 by a brush of the developing roller 14.

In the toner recovery roller 220, the insulating layer 220*c* in the outer peripheral part of the toner recovery roller 220 has a thick part and a thin part. Accordingly, even if a charging potential in the thick part of the insulating layer 220*c* is higher, it is easy to scrap the toner particles adhering to the thick part.

Figure 20:
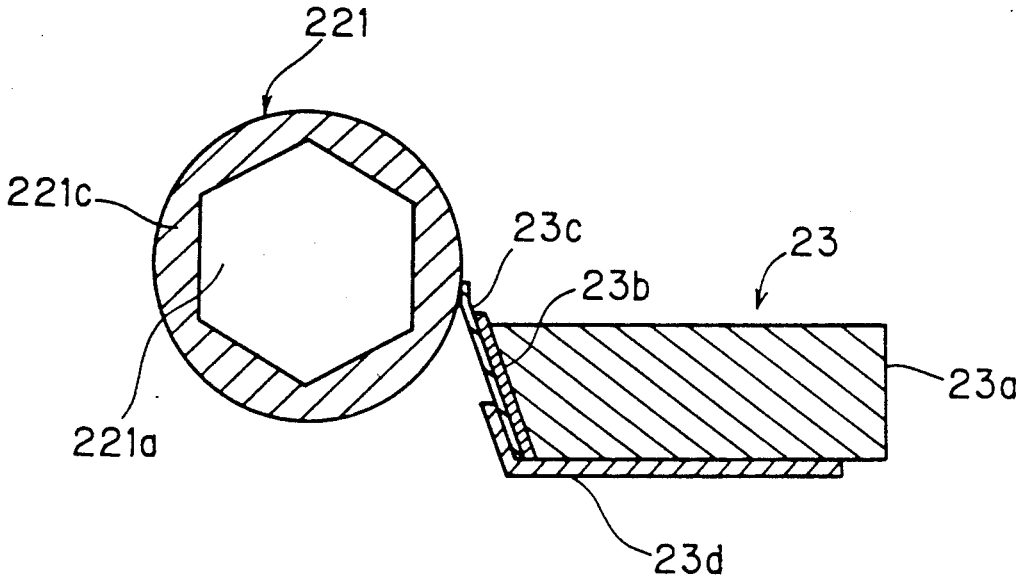
FIG. 20 is a transverse sectional view showing another modified example of a toner recovery roller.
Figure 21:
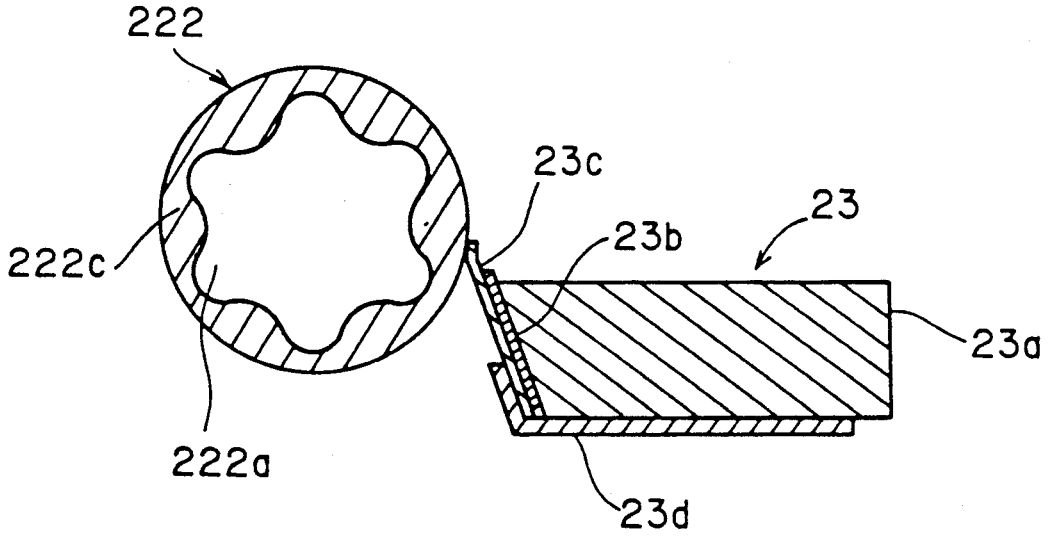
FIG. 21 is a transverse sectional view showing still another modified example of a toner recovery roller.
Figure 22:
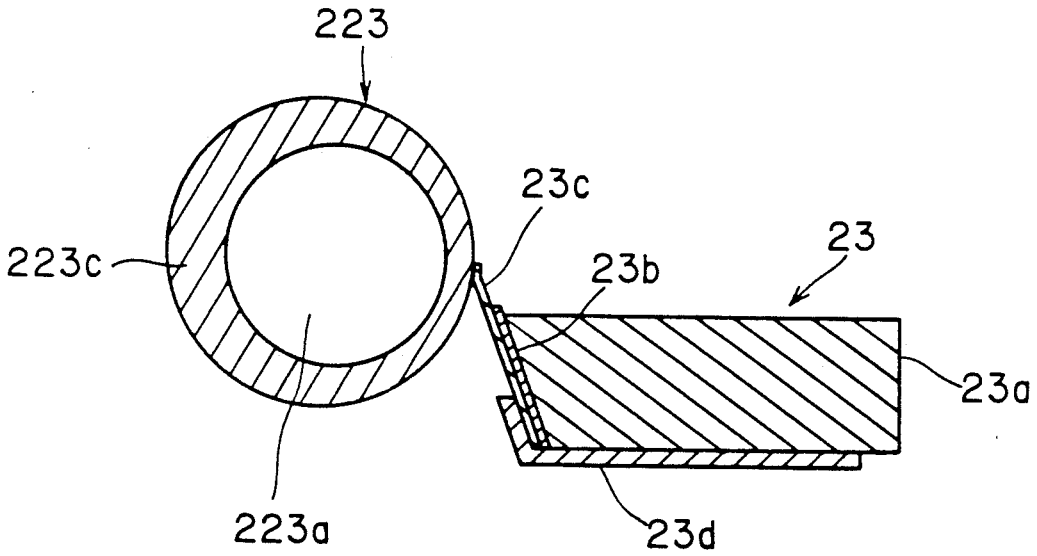
FIG. 22 is a transverse sectional view showing a further modified example of a toner recovery roller.

FIGS. 20, 21 and 22 respectively show modified examples of atoner recovery roller.

A toner recovery roller 221 shown in FIG. 20 is so formed as to be in a circular shape in cross section centered at the center in cross section of a roller 221*a* which is hexagonal in cross section after an outer surface of the roller 221*a* is coated with insulating synthetic resin.

A toner recovery roller 222 shown in FIG. 21 is so formed as to be in a circular shape in cross section centered at the center in cross section of a roller 222*a* which is in a petal shape in cross section after an outer surface of the roller 222*a* is coated with insulating synthetic resin.

A toner recovery roller 223 shown in FIG. 23 is so formed as to be in a circular shape in cross section centered at a position shifted from the center in cross section of a roller 223*a* which is circular in cross section after an outer surface of the roller 223*a* is coated with insulating synthetic resin.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus in which a toner recovery roller having at least its outer peripheral part made of an insulator and rotated and driven in a predetermined direction is disposed in the vicinity of a position where an image carrier and a developing roller interact with each other, and a triboelectric charging member for triboelectrically charging an outer peripheral surface of said toner recovery roller to a polarity opposite to that of toner particles is so provided as to be brought into contact with the outer peripheral surface of said toner recovery roller.

2. The image forming apparatus according to claim 1, wherein said toner recovery roller comprises a metal roller and an insulating layer formed on an outer peripheral surface of said metal roller.

3. The image forming apparatus according to claim 1, wherein the whole of said toner recovery roller is made of an insulating material.

4. The image forming apparatus according to claim 1, wherein said triboelectric charging member is also used as a toner scrapping member for scrapping toner particles attracted to said toner recovery roller and adhering thereto.

5. The image forming apparatus according to claim 1, wherein said toner recovery roller comprises a conductive roller and an insulating layer formed on an outer peripheral surface of the conductive roller, and said triboelectric charging member is conductive.

6. The image forming apparatus according to claim 1, wherein said toner recovery roller is rotated and driven intermittently and at a speed having an acceleration.

7. The image forming apparatus according to claim 6, wherein said toner recovery roller is rotated and driven intermittently and at a speed having an acceleration by a roller driving mechanism comprising a lever mounted on a shaft of said toner recovery roller and rotated integrally with said toner recovery roller in one direction of rotation while being idled with respect to said toner recovery roller in the other direction of rotation, a cam rotated at a constant speed in a predetermined direction and for rotating said lever, and urging means for always urging said lever in the direction in which the lever is idled with respect to said toner recovery roller to bring said lever into contact with said cam by pressure.

8. The image forming apparatus according to claim 1, wherein said toner recovery roller comprises a metal roller and an insulating layer formed on an outer peripheral surface of the metal roller, said insulating layer of said toner recovery roller having a thick part and a thin part in a peripheral direction.

9. The image forming apparatus according to claim 1, wherein said toner recovery roller and said triboelectric charging member are mounted on the same frame to be formed as a unit.

10. The image forming apparatus according to claim 9, wherein said triboelectric charging member is mounted on said frame such that the position thereof can be adjusted with respect to said toner recovery roller.

11. The image forming apparatus according to claim 1, wherein both ends of said toner recovery roller are received by bearings, bearing fitting notches in which said bearings of said toner recovery roller are to be fitted are formed in predetermined positions of required members of said developing device, and said toner recovery roller is mounted on said developing device with said bearings of said toner recovery roller being respectively fitted in said bearing fitting notches.

12. The image forming apparatus according to claim 11, wherein each of said bearings of said toner recovery roller has substantially elliptical bearing parts, each of said bearing fitting notches has a narrow part of an opening having a width slightly larger than the length of minor axes of said substantially elliptical bearing parts and a circular part connecting with said narrow part and having a diameter slightly larger than the length of major axes of said substantially elliptical bearing parts, and said substantially elliptical bearing parts of the bearing of said toner recovery roller are fitted in the circular part of the bearing fitting notch from the narrow part thereof and then, are rotated through a predetermined angle, so that said substantially elliptical bearing parts are fitted to said circular part.

13. The image forming apparatus according to claim 11, wherein said toner recovery roller and said triboelectric charging member are mounted on the same frame to be formed as a unit.

14. An image forming apparatus comprising:

a toner recovery roller disposed in the vicinity of a position where an image carrier and a developing roller interact with each other;

a triboelectric charging member provided so as to be brought into contact with an outer peripheral surface of the toner recovery roller and for triboelectrically charging the outer peripheral surface of the toner recovery roller to a polarity opposite to that of toner particles; and a toner scrapping member provided so as to be brought into contact with the outer peripheral surface of the toner recovery roller and for scrapping toner particles attracted to the toner recovery roller and adhering hereto, the toner recovery roller comprising a metal roller and an insulating layer formed on an outer peripheral surface of the metal roller, the insulating layer of the toner recovery roller having a thick part and a thin part in a peripheral direction.

15. The image forming apparatus according to claim 14, wherein said triboelectric charging member is also used as said toner scrapping member.

* * * * *